US008593042B1

(12) United States Patent
Lee

(10) Patent No.: US 8,593,042 B1
(45) Date of Patent: Nov. 26, 2013

(54) LED LAMP AND HEAT DISSIPATION DEVICE THEREOF

(75) Inventor: Ching-Chuan Lee, New Taipei (TW)

(73) Assignee: Wantai Technology Corporation, New Taipei (TW)

( * ) Notice: Subject to any disclaimer, the term of this patent is extended or adjusted under 35 U.S.C. 154(b) by 0 days.

(21) Appl. No.: 13/594,801

(22) Filed: Aug. 25, 2012

(51) Int. Cl.
*H01J 1/02* (2006.01)

(52) U.S. Cl.
USPC ..... 313/46; 362/294

(58) Field of Classification Search
USPC ..... 362/294; 313/46
See application file for complete search history.

(56) References Cited

U.S. PATENT DOCUMENTS 7,604,380 B2 * 10/2009 Burton et al. ..... 362/294
8,053,960 B2 * 11/2011 Liu et al. ..... 313/46

* cited by examiner

*Primary Examiner* — Mary Ellen Bowman
(74) *Attorney, Agent, or Firm* — Guice Patents PLLC

(57) ABSTRACT

The present invention provides a heat dissipation device, which comprises: a base; plural heat dissipation pipes, wherein each heat dissipation pipe is hollow and formed in an L-like shape, one end thereof passes the base, the other end thereof is received at the bottom of the base; and a heat dissipation plate having a main body, the center of the main body is formed with a chamber having its outer periphery formed with plural heat dissipation grooves, the outer side of the main body is formed with plural wavelike shaped heat dissipation fins. With the aforementioned structure, advantages of smaller in volume, lighter in weight and more efficient in heat dissipation can be achieved.

5 Claims, 4 Drawing Sheets

LED LAMP AND HEAT DISSIPATION DEVICE THEREOF

BACKGROUND OF THE INVENTION

1. Field of the Invention

The present invention relates to an LED lamp and a heat dissipation device thereof, especially to an LED lamp and a heat dissipation device thereof in which a base and a heat dissipation plate being installed, the base is installed with plural L-like shaped heat dissipation pipes, the outer side of a main body of the heat dissipation plate is formed with plural wavelike shaped fins, thereby having the advantages of smaller in volume, lighter in weight and more efficient in heat dissipation.

2. Description of Related Art

A LED lamp has the features of energy saving and long service life, therefore the LED lamp becomes the main stream for the next-generation lighting device. A conventional LED lamp is often installed with a metal housing, the metal housing is integrally formed through aluminum extrusion or formed through processing a metal treatment, e.g. lathing or milling, to a solid aluminum bar, then the outer periphery thereof is formed with several heat dissipation fins for the purpose of heat dissipation.

Take the U.S. Patent Application No. 2010/0084116, the U.S. Patent Application No. 2011/0221324 and the U.S. Patent Application No. 2011/0215696 for examples, the LED lamps disposed in the aforesaid patent applications are all integrally formed with a heat dissipation plate through an aluminum extrusion means, then the outer periphery is formed with several heat dissipation fins for the purpose of heat dissipation; however, the disclosed heat dissipation structure is complicated and the production cost is inevitably increased.

Moreover, the difference between the LED lamps disclosed in the U.S. Pat. No. 7,494,249, the U.S. Pat. No. 7,744,250, the U.S. Pat. No. 7,748,876 and the U.S. Patent Application No. 2010/0243211 and the LED lamps disclosed in the U.S. Patent Application No. 2010/0084116, the U.S. Patent Application No. 2011/0221324 and the U.S. Patent Application No. 2011/0215696 is that the LED lamps disclosed in the aforesaid patents or patent application is installed with one or more heat dissipation pipes for transferring heat to the aluminum-extruded heat dissipation plate, so the heat dissipation can be conducted through the heat dissipation fins installed thereon, thereby increasing the heat dissipation efficiency.

However, the disclosed heat dissipation structure is complicated in manufacturing thereby causing the higher production cost, and the aluminum-extruded heat dissipation plate is large in volume, heavy in weight, thereby causing the volume of LED lamp to be incapable of reducing; the mentioned shortages shall be improved.

As such, a novel LED lamp and a heat dissipation device thereof capable of overcoming the mentioned shortages shall be provided.

SUMMARY OF THE INVENTION

One primary objective of the present invention is to provide a heat dissipation device, which is installed with a base and a heat dissipation plate, the base is installed with plural L-like shaped heat dissipation pipes, the outer side of a main body of the heat dissipation plate is formed with plural wavelike shaped fins, thereby increasing the heat dissipation efficiency and having the advantages of smaller in volume, lighter in weight and more efficient in heat dissipation.

Another objective of the present invention is to provide a LED lamp, wherein a heat dissipation device provided therein is installed with a base and a heat dissipation plate, the base is installed with plural L-like shaped heat dissipation pipes, the outer side of a main body of the heat dissipation plate is formed with plural wavelike shaped fins, thereby increasing the heat dissipation efficiency and having the advantages of smaller in volume, lighter in weight and more efficient in heat dissipation.

For achieving the objectives, the present invention provides a heat dissipation device, which includes: a base formed with plural recessed grooves at the bottom surface, and the inner end of each recessed groove is formed with a penetrated hole; plural heat dissipation pipes, wherein each heat dissipation pipe is hollow and formed in an L-like shape, one end thereof passes the base through the penetrated hole, the other end thereof is received in the recessed groove; and a heat dissipation plate having a main body, the center of the main body is formed with a chamber having its outer periphery installed with plural heat dissipation grooves, and each heat dissipation groove is arranged at equal interval, the outer side of the main body is formed with plural wavelike shaped heat dissipation fins.

For achieving the objectives, the present invention provides a LED lamp, which comprises: a housing having an accommodation space; a heat dissipation device accommodated in the accommodation space; a substrate disposed at a lateral side of the heat dissipation device; a light emitting diode disposed on the substrate and used for emitting light; a light guide plate disposed at the front side of the substrate for guiding the light emitted by the light emitting diode; a lens disposed at the front side of the light guide plate, so the light emitted by the light emitting diode can be condensed then projected out of the lens; a front cover covered at the front end of the housing; a rear cover covered at the rear end of the housing; and a power unit coupled to the light emitting diode for supplying the electric power required by the light emitting diode.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
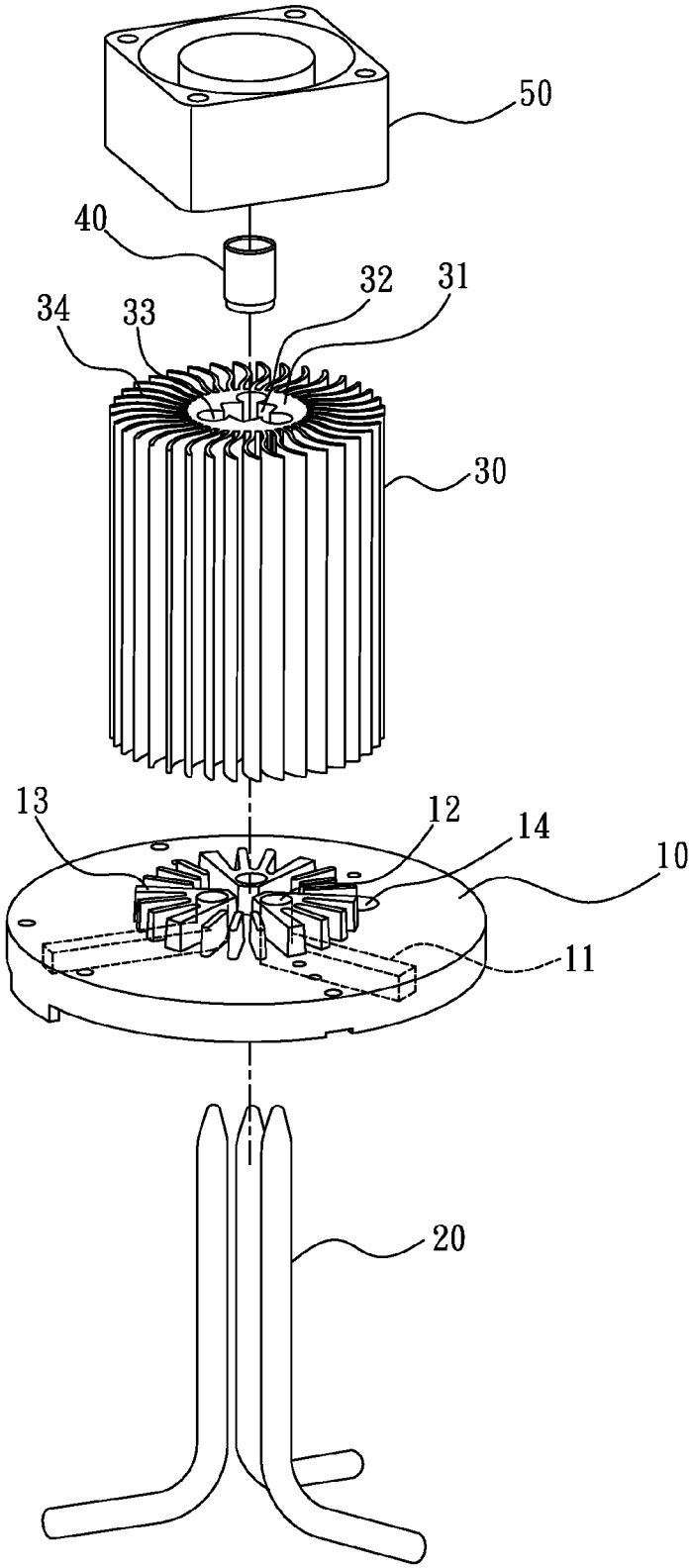
FIG. 1 is a schematic exploded view illustrating the heat dissipation device according to one preferred embodiment of the present invention.
Figure 2:
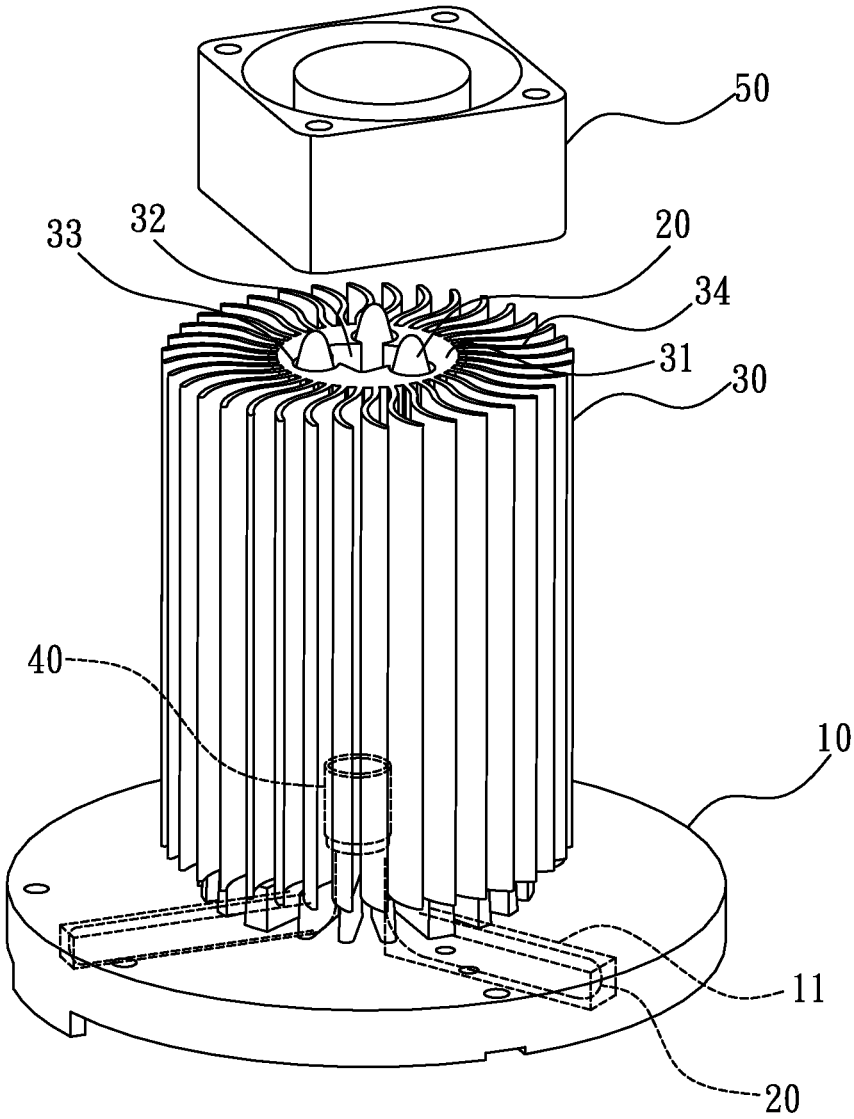
FIG. 2 is a schematic view illustrating the assembly of the heat dissipation device according to one preferred embodiment of the present invention.

Referring to FIG. 1 and FIG. 2, wherein FIG. 1 is a schematic exploded view illustrating the heat dissipation device according to one preferred embodiment of the present invention; and FIG. 2 is a schematic view illustrating the assembly of the heat dissipation device according to one preferred embodiment of the present invention.

As shown in figures, the heat dissipation device provided by the present invention is capable of being applied in a LED lamp, the LED lamp is e.g. but not limited to a street lamp or garden lamp; the heat dissipation device comprises: a base 10; plural heat dissipation pipes 20 and a heat dissipation plate 30.

The bottom surface of the base 10 is formed with plural recessed grooves 11, and the inner end of each recessed groove 11 is formed with a penetrated hole 12. The base 10 is made of a metal material, e.g. but not limited to aluminum. In addition, the top of the base 10 is provided with plural stop blocks 13, and an outer end of one of the stop blocks 13 is further formed with a wire hole 14, the stop block 13 allows a gap to be formed between the base 10 and the heat dissipation plate 30 thereby enabling the wire hole 14 to be exposed, so as to allow a wire (not shown in figures) to pass the wire hole 14. Moreover, the bottom surface of the base 10 is printed with a layer of heat dissipation paste (not shown in figures) thereby enhancing the heat dissipation effect.

According to the present invention, each heat dissipation pipe 20 is hollow and formed in an L-like shape, one end thereof can pass the base 10 through the penetrated hole 12, the other end thereof is received in the recessed groove 11. The recessed grooves 11 are arranged at the bottom surface of the base 10 at equal angles. The heat dissipation pipe 20 is filled with liquid or gas (both not shown in figures) thereby heat dissipation being enabled to be conducted through the gravity and capillary force of the heat dissipation pipe 20 and the air convection, wherein the liquid is e.g. but not limited to pure water. The quantity of the heat dissipation pipe 20 can be altered according to the required power consumption of the LED lamp, when the power consumption of the LED lamp is small, less quantity of the heat dissipation pipe 20 is required, when the power consumption of the LED lamp is large, more heat dissipation pipes 20 can be adopted.

The heat dissipation plate 30 has a main body 31 having a chamber 32 formed in the center, the outer periphery of the chamber 32 is formed with plural heat dissipation grooves 33, and each heat dissipation groove 33 is arranged at an equal interval for being accommodated in the heat dissipation pipe 20, and the outer side of the main body 31 is formed with plural wavelike shaped heat dissipation fins 34 thereby increasing the heat dissipation area.

In addition, the heat dissipation device of the present invention is further installed with a metal sleeve 40 which can be disposed at the bottom of the chamber 32 with a punching means thereby supporting the plural heat dissipation pipes 20.

Moreover, the heat dissipation device of the present invention is further installed with a fan 50 which is disposed at the top of the heat dissipation plate 30, thereby enabling the heat gathered in the heat dissipation plate 30 to be discharged for increasing the heat dissipation effect.

As shown in FIG. 2, when the base 10, the plural heat dissipation pipes 20, the heat dissipation plate 30 and the metal sleeve 40 are assembled with, e.g. but not limited to, a punching means, the heat absorbed by the base 10 can be transferred to the plural heat dissipation pipes 20 and the heat dissipation plate 30, liquid in the plural heat dissipation pipes 20 is evaporated by the heat, the vapor enables the fluid to be condensed to a liquid phase at a heat discharge end, and returned to heat absorbing ends (i.e. two ends of the heat dissipation pipe 20) through the gravity or capillary force thereby forming a circulative operation for dissipating heat; furthermore, the fan 50 can be used for facilitating the heat at the distal end of the heat dissipation pipe 20 and the heat in the heat dissipation plate 30 to be discharged, thereby facilitating the heat dissipation effect of the heat dissipation device provided by the present invention, and enabling the effect of lowering temperature to be rapidly achieved.

Figure 3:
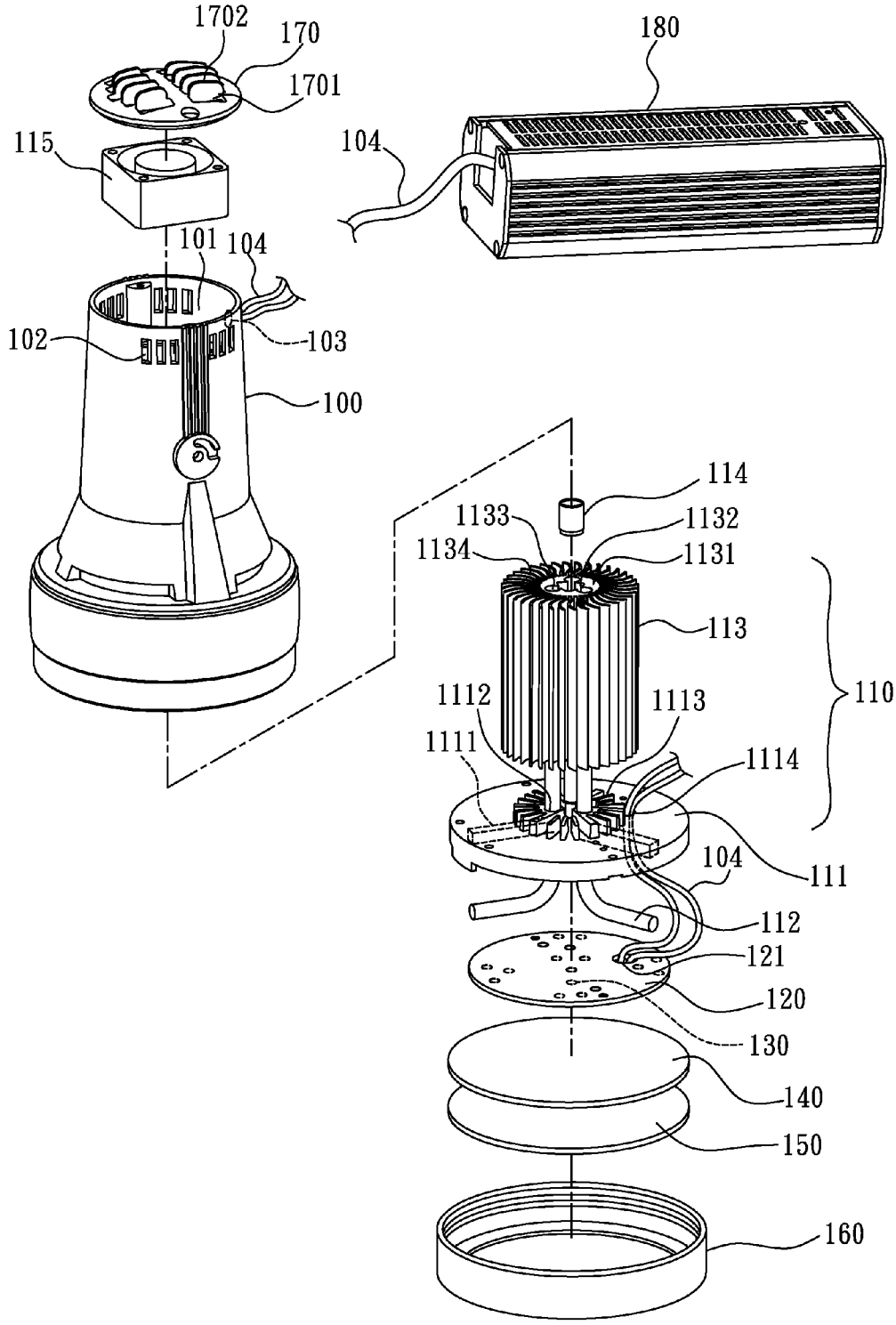
FIG. 3 is a schematic exploded view illustrating the LED lamp according to another preferred embodiment of the present invention.
Figure 4:
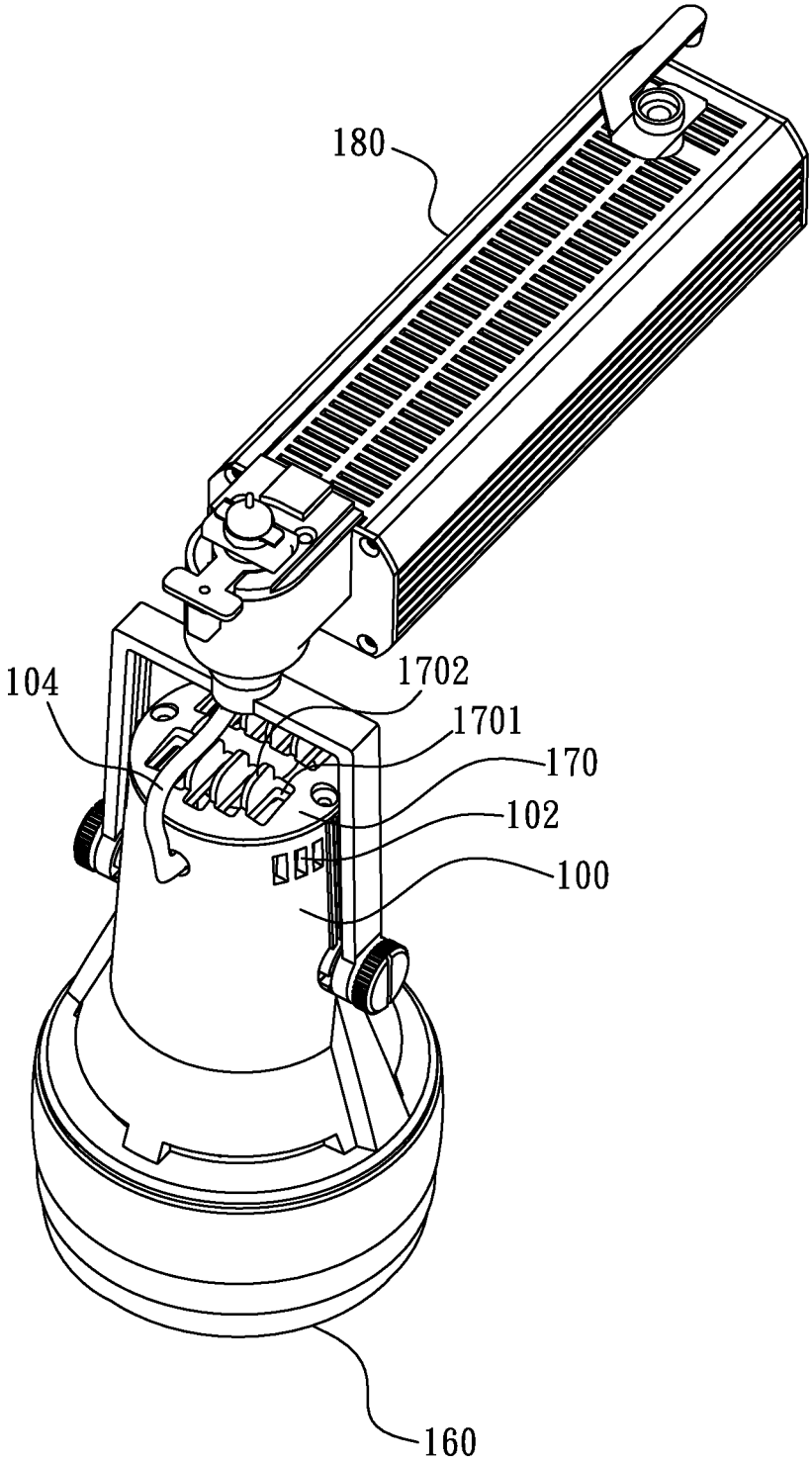
FIG. 4 is a schematic view illustrating the assembly of the LED lamp according to another preferred embodiment of the present invention.

Referring to FIG. 3 and FIG. 4, wherein FIG. 3 is a schematic exploded view illustrating the LED lamp according to another preferred embodiment of the present invention; and FIG. 4 is a schematic view illustrating the assembly of the LED lamp according to another preferred embodiment of the present invention.

As shown in figures, the present invention provides an LED lamp, which comprises: a housing 100; a heat dissipation device 110; a substrate 120; a light emitting diode 130; a light guide plate 140; a lens 150; a front cover 160; a rear cover 170; and a power unit 180.

The housing 100 is made of a metal material, e.g. but not limited to aluminum, an opening thereof is formed in a gradually-expanded state, and the housing 100 is formed with an accommodation space 101, the rear end of the housing 100 is formed with plural first ventilation grooves 102 and a wire hole 103, wherein the first ventilation grooves 102 can be used for assisting air to be introduced into the housing 100 with a convection means for the purpose of heat dissipation. The wire hole 103 allows a wire 104 to enter the housing 100.

The heat dissipation device 110 is disposed in the accommodation space 101, made of a metal material, and further installed with: a base 111; plural heat dissipation pipes 112; a heat dissipation plate 113; a metal sleeve 114; and a fan 115.

The bottom surface of the base 111 is formed with plural recessed grooves 1111, and the inner end of each recessed groove 1111 is formed with a penetrated hole 1112. The base 111 is made of a metal material, e.g. but not limited to aluminum. In addition, the top of the base 111 is provided with plural stop blocks 1113, and an outer end of one of the stop blocks 1113 is further formed with a wire hole 1114, the stop block 1113 allows a gap to be formed between the base 111 and the heat dissipation plate 113 thereby enabling the wire hole 1114 to be exposed, so as to allow the wire 104 to pass the wire hole 1114. Moreover, the bottom surface of the base 111 is printed with a layer of heat dissipation paste (not shown in figures) thereby enhancing the heat dissipation effect.

According to the present invention, each heat dissipation pipe 112 is hollow and formed in an L-like shape, one end thereof can pass the base 111 through the penetrated hole 1112, the other end thereof is received in the recessed groove 1111. The recessed grooves 1111 are arranged at the bottom surface of the base 111 at equal angles. The heat dissipation pipe 112 is filled with liquid or gas (both not shown in figures) thereby heat dissipation being enabled to be conducted through the gravity and capillary force of the heat dissipation pipe 112 and the air convection, wherein the liquid is e.g. but not limited to pure water. The quantity of the heat dissipation pipe 112 can be altered according to the required power consumption of the LED lamp, when the power consumption of the LED lamp is small, less quantity of the heat dissipation pipe 112 is required, when the power consumption of the LED lamp is large, more heat dissipation pipes 112 can be adopted.

The heat dissipation plate 113 has a main body 1131 having a chamber 1132 formed at the center, the outer periphery of the chamber 1132 is formed with plural heat dissipation grooves 1133, and each heat dissipation groove 1133 is arranged at an equal interval for being received in the heat dissipation pipe 112, and the outer side of the main body 1131 is formed with plural wavelike shaped heat dissipation fins 1134 thereby increasing the heat dissipation area.

The metal sleeve 114 is disposed at the bottom of the chamber 1132 thereby supporting the plural heat dissipation pipes 112.

The fan 115 is disposed at the top of the heat dissipation plate 113, thereby enabling the heat gathered in the heat dissipation plate 113 to be discharged for increasing the heat dissipation effect.

The substrate 120 is disposed at a lateral side of the heat dissipation device 110, e.g. but not limited to the front side, and preferably to be disposed on the bottom surface of the base 111, wherein the substrate 120 is e.g. but not limited to a copper substrate or aluminum substrate for enhancing the heat dissipation capability. Wherein, the substrate 120 is formed with a wire hole 121 corresponding to the wire hole 1114, and a layer of heat dissipation paste (not shown in figures) is printed between the substrate 120 and the bottom surface of the base 111, thereby increasing the heat dissipation efficiency.

The light emitting diode 130 is disposed on the substrate 120 for illumination, and is equipped with an anode and a cathode (both not shown in figures) for being connected with the wire 104. Wherein, the light emitting diode 130 is e.g. but not limited to a high power light emitting diode, and the quantity thereof can be altered according to actual needs.

The light guide plate 140 is disposed at the front side of the substrate 120 for guiding the light emitted by the light emitting diode 130.

The lens 150 is disposed at the front side of the light guide plate 140, so the light emitted by the light emitting diode 130 can be condensed then projected out of the lens 150, wherein the lens 150 is e.g. but not limited to a transparent or translucent glass.

The front cover 160 is made of a metal material, e.g. but not limited to aluminum, and covered at the front end of the housing 100.

The rear cover 170 is made of a metal material, e.g. but not limited to aluminum, and covered at the rear end of the housing 100, and the rear cover 170 is formed with plural second ventilation grooves 1701, and each second ventilation groove 1701 is further formed with a heat dissipation fin 1702, wherein the second ventilation grooves 1701 can be used for assisting air to be introduced into the housing 100 with a convection means, the heat dissipation fins 1702 can be used for enhancing the heat dissipation effect.

One end of the power unit 180 is coupled to an AC power source (not shown in figures), and used for lowering the voltage of AC power source and rectifying, and the power unit 180 utilizes the wire 104 to respectively pass the wire holes 103, 1114, 121 for being coupled to the light emitting diode 130 thereby supplying the electric power required by the light emitting diode 130; moreover, the wire 104 can also be coupled to the fan 115 for supplying the electric power required by the fan 115.

As shown in FIG. 4, when being assembled, the heat dissipation device 110 is assembled with the substrate 120, one end of the wire 104 passes the wire holes 103, 1114, 121 for being coupled to the light emitting diode 130; the heat dissipation device 110 and the substrate 120 are fastened in the accommodation space 101 of the housing 100; the light guide plate 140 and the lens 150 are assembled on the front cover 160, then the front cover 160 is fastened at the front edge of the housing 100; the fan 115 is fastened at the rear side of the housing 100 by utilizing at least a screw (not shown in figures); the rear cover 170 is fastened on the housing 100 by utilizing at least a screw (not shown in figures), thereby finishing the assembly.

When being used, one end of the power unit 180 is coupled to an AC power source (not shown in figures), the power unit 180 performs processes of voltage lowering and rectifying, then the wire 104 is used for transferring the DC power to the light emitting diode 130 and the fan 115, thereby enabling the light emitting diode 130 to emit light and enabling the fan 115 to operate. The heat generated by the light emitting diode 130 can be transferred through the base 111 to the plural heat dissipation pipes 112, then the plural wavelike shaped heat dissipation fins 1134 of the heat dissipation plate 113 can be used for dissipating heat through its large heat dissipation area, furthermore, the operation of the fan 115 can facilitate the heat dissipation process. As such, the objective of rapidly lowering temperature can be achieved, and the LED lamp provided by the present invention has advantages of reducing the volume and weight of LED lamp.

As what has been disclosed above, according to the LED lamp and the heat dissipation device thereof provided by the present invention, the heat dissipation device has a base and a heat dissipation plate, the base is installed with plural L-like shaped heat dissipation pipes, the outer side of the main body of the heat dissipation plate is formed with plural wavelike shaped fins for increasing the heat dissipation efficiency, thereby having the advantages of smaller in volume, lighter in weigh and faster in heat dissipation. As such, the present invention is novel comparing to conventional LED lamp.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. An LED lamp, comprising:

a housing having an accommodation space;

a heat dissipation device accommodated in said accommodation space;

a substrate disposed at a lateral side of said heat dissipation device;

a light emitting diode disposed on said substrate and used for emitting light;

a lens disposed at the front side of said substrate, so the light emitted by said light emitting diode being able to be condensed then projected out of said lens;

a front cover covered at the front end of said housing;

a rear cover covered at the rear end of said housing; and a power unit coupled to said light emitting diode for supplying the electric power required by said light emitting diode;

wherein said heat dissipation device further includes:

a base formed with plural recessed grooves at the bottom surface, and the inner end of each recessed groove is formed with a penetrated hole;

plural heat dissipation pipes, wherein each heat dissipation pipe is hollow and formed in an L-like shape, one end thereof passes said base through said penetrated hole, the other end thereof is received in said recessed groove; and a heat dissipation plate having a main body, the center of said main body is formed with a chamber having its outer periphery formed with plural heat dissipation grooves, and each heat dissipation groove is arranged at equal interval for being received in said heat dissipation pipe, the outer side of said main body is formed with plural wavelike shaped heat dissipation fins.

2. The LED lamp as claimed in claim 1, wherein said housing, said front cover and said rear cover are made of a metal material, and the rear end of said housing is formed with plural first ventilation grooves and a wire hole, said rear cover is formed with plural second ventilation grooves, and each second ventilation groove is further formed with a heat dissipation fin.

3. The LED lamp as claimed in claim 1, wherein the bottom surface of said base is further printed with a layer of heat dissipation paste, and said substrate is a copper substrate or an aluminum substrate.

4. The LED lamp as claimed in claim 1, further including:

a fan disposed at the top of said heat dissipation plate; and a light guide plate disposed at the front side of said substrate for guiding the light emitted by said light emitting diode.

5. The LED lamp as claimed in claim 1, wherein the quantity of said recessed grooves, the quantity of said heat dissipation pipes and the quantity of said heat dissipation grooves are all three.

* * * * *

UNITED STATES PATENT AND TRADEMARK OFFICE

CERTIFICATE OF CORRECTION

PATENT NO. : 8,593,042 B1
APPLICATION NO. : 13/594801
DATED : November 26, 2013
INVENTOR(S) : Ching-Chuan Lee It is certified that error appears in the above-identified patent and that said Letters Patent is hereby corrected as shown below:

On the title page, item (73) should read as follows:

--(73) Assignee Wentai Technology Corporation, New Taipei City (TW)--

Signed and Sealed this
Sixth Day of May, 2014

Michelle K. Lee

Michelle K. Lee
*Deputy Director of the United States Patent and Trademark Office*